US005215429A

United States Patent [19]

Sun

[11] Patent Number: 5,215,429

[45] Date of Patent: Jun. 1, 1993

[54] REGENERATIVE TURBINE HAVING PREDETERMINED CLEARANCE RELATIONSHIP BETWEEN CHANNEL RING AND IMPELLER

[75] Inventor: Hongwei Sun, Naperville, Ill.

[73] Assignee: General Signal Corporation, Stamford, Conn.

[21] Appl. No.: 819,022

[22] Filed: Jan. 10, 1992

[51] Int. Cl.[5] ..... F04D 29/42

[52] U.S. Cl. ..... 415/55.4; 415/55.1

[58] Field of Search ..... 415/55.1, 55.2, 55.3, 415/55.4, 55.5, 55.6, 55.7

[56] References Cited

U.S. PATENT DOCUMENTS

| | | | |
|---|---|---|---|
| 1,920,484 | 8/1933 | Siemen et al. | 415/55.1 |
| 2,015,200 | 9/1935 | Spoor | 415/55.1 |
| 3,402,669 | 9/1968 | Mamo | 415/55.2 |
| 4,586,877 | 5/1986 | Watanabe et al. | 415/55.1 |
| 4,958,984 | 9/1990 | Aoi et al. | 415/55.1 |

*Primary Examiner*—Edward K. Look
*Assistant Examiner*—Christopher Verdier
*Attorney, Agent, or Firm*—Milton E. Kleimman; Ray E. Smiley; Robert S. Smith

[57] ABSTRACT

A regenerative turbine pump apparatus which includes a housing having an inlet and an outlet and an impeller mounted for rotation within the housing. The impeller has an outer diameter and a channel ring is disposed around the impeller. The channel ring has a first arcuate portion that has a first radius to provide a substantially uniform first clearance with respect to the outer diameter of the impeller and the first arcuate portion extends throughout a major part of the channel ring. The channel ring includes a second arcuate portion proximate to the inlet having a second clearance with respect to the outer diameter of the impeller that is greater than the first clearance.

5 Claims, 2 Drawing Sheets

SECTION O-E

SECTION O-D

SECTION O-C

SECTION O-B

SECTION O-A

SECTION F-F

REGENERATIVE TURBINE HAVING PREDETERMINED CLEARANCE RELATIONSHIP BETWEEN CHANNEL RING AND IMPELLER

BACKGROUND OF THE INVENTION

The invention relates to regenerative turbine pumps which in some cases are also referred to as turbine pumps, periphery pumps, turbulence pumps, or friction pumps. The turbine pump name has been used because of the plurality of vanes, resembling those of a steam turbine, that are machined into the periphery of the impeller that is rotated at high speed. Two basic types are known. One type has inclined vanes on only one side of an impeller. The more commonly used type has radial vane impellers. While the invention will be described in terms of the latter type it will be understood by those skilled in the art that the invention has application to both forms.

Regenerative turbine pumps are particularly suitable for air conditioning, refrigeration, and heating applications. Regenerative turbine pumps will move a relatively low flow of fluid at a relatively high head. More specifically, such pumps have a relatively steep head capacity curve. The regenerative turbine pump has higher efficiencies at low flows than a centrifugal pump. A regenerative turbine type pump typically will produce several times the pressure produced by a centrifugal pump having an impeller of equal diameter and operating at the same speed.

Conventional regenerative turbine pumps utilize close running tolerances. More particularly, the impeller vanes usually run at very close axial clearances within machined channel rings disposed within the pump housing to minimize recirculation losses. The channel ring around each impeller provides a circular channel around the vane area of the impeller from the inlet to the outlet. It is known in the prior art to provide greater axial clearance between the vanes and the adjacent channel ring wall near the inlet of the pump than at parts of the channel ring. It is also known in the prior art to gradually decrease that axial clearance between the sides of the vanes and the side walls of the channel ring from a point near the inlet through an angular sector.

In a single stage regenerative turbine pump the fluid enters the channel on both sides of the impeller adjacent to a first circumferential part of the impeller. The vanes carry the fluid within the channel for almost a full revolution. A blocker or splitter directs the fluid through an outlet.

Some forms of regenerative turbine pumps may be multistage structures. Two stage regenerative turbine pumps direct a fluid from a first stage to a second stage. If the respective discharges are offset by 180 degrees the radial loads on the bearings are nearly balanced and shaft deflection is minimized.

Pumps of this type having a top center line discharge are self venting and have the ability to handle vapors without vapor lock. This characteristic allows handling of boiling liquids and liquified gases at suction heads slightly over the vapor pressure.

Regenerative turbine pumps have many advantages including even a characteristic of superior suction lift. More particularly, they are preferred for lifting liquids from lower levels and particularly for hot liquids and liquids that vaporize at normal temperatures.

Although regenerative turbine pumps are desirable for superior suction lift there are still many applications where there is insufficient net positive suction head to operate conventional regenerative turbine pumps. Net positive suction head is the absolute pressure, above the vapor pressure of the liquid being pumped, at the pump suction flange.

If the net positive suction head pressure available to the pump is insufficient, the pump will cavitate and serious operational difficulties may develop. These troubles can include reduction in capacity and efficiency, excessive vibration, reduced life of pump parts due to cavitation erosion, and damage to the pump from possible vapor lock and running dry.

One way to solve the problem is to set up the pumping system so that the NPSH (net positive suction head pressure) available from the system is greater than the NPSH required by the pump. In some pump systems this has been achieved by an elevated inlet tank or other costly design considerations. For example, it may be necessary to lower the pump with respect to a supply tank by providing a pit in which the pump is disposed. For other installations multiple pumps in parallel or a discrete booster pump in series or large pipelines to decrease friction losses. Discrete rotating impellers have also been used in series with another impeller to overcome the pressure drop between the suction flange of the pump and the entrance to the impeller vanes.

The change of the physical arrangement is often inconvenient, expensive or even impossible. Therefore, when a pump is selected for a particular application the NPSH requirement of the pump is an important characteristic.

It is an object of the invention to provide a construction that will have a lower net positive suction head pressure requirement.

It is an object of the invention to provide apparatus that will have a longer service life because of the elimination of operating problems such as cavitation.

It is an object of the invention to provide apparatus which is inexpensive to manufacture.

Still another object of the invention is to provide apparatus that will not increase the assembly time in any way.

SUMMARY OF THE INVENTION

It has now been found that these and other objects of the invention may be attained in a regenerative turbine pump apparatus which includes a housing having an inlet and an outlet and an impeller mounted for rotation within the housing. The impeller has an outer diameter. A channel ring is disposed around the impeller. The channel ring has a first arcuate portion that has a first radius to provide a substantially uniform first clearance with respect to the outer diameter of the impeller and the first arcuate portion extends throughout a major part of the channel ring. The channel ring includes a second arcuate portion proximate to the inlet having a second clearance with respect to the outer diameter of the impeller that is greater than the first clearance.

In some forms of the invention the second clearance is greater nearer to the inlet than at parts thereof remote from the inlet. The second clearance may taper from the first clearance to a maximum at a point proximate to the inlet.

The second arcuate portion may extend through an arc of up to 90 degrees and may have an arc shape having a radius greater than an arc defining the first arcuate portion. The second arcuate portion may have a center of curvature that is different from the center of curvature of the first arcuate portion.

BRIEF DESCRIPTION OF THE DRAWINGS

The invention will be better understood by reference to the accompanying drawing in which:

FIG. 5 is a sectional view taken along the line O-C of FIG. 2.

DESCRIPTION OF THE PREFERRED EMBODIMENT

Figure 1:
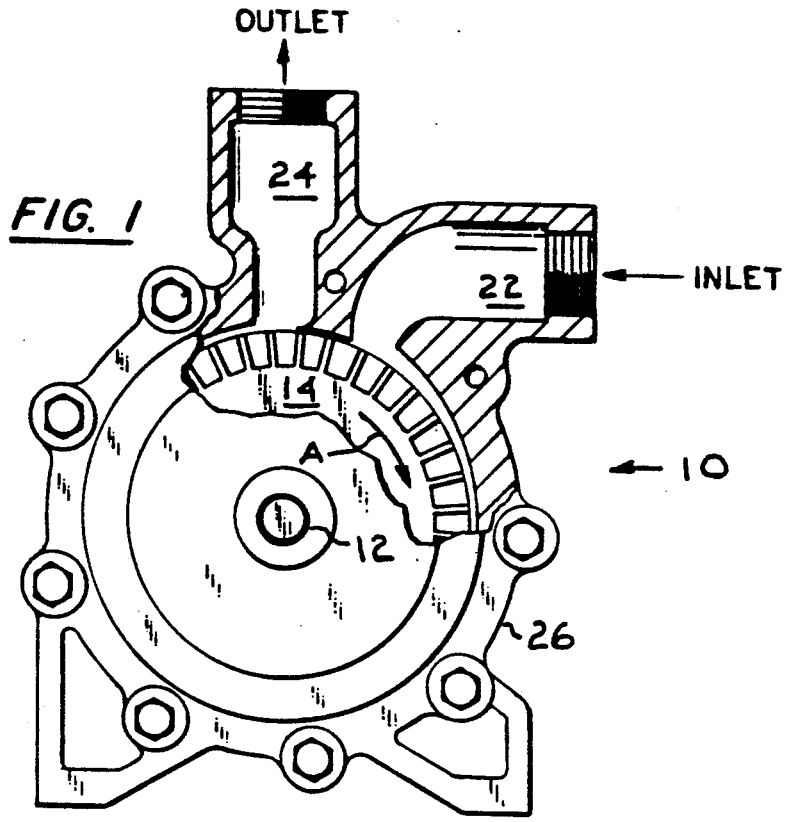
FIG. 1 is a side elevational view in partial section of a regenerative turbine pump in accordance with one form of the invention.

Referring now to FIGS. 1–8 there is shown a regenerative turbine pump 10. In FIG. 1 the view is taken in a direction parallel to the pump shaft 12, broken away. The pump 10 is shown in partial section in the region of the inlet 22 and outlet 24 of a pump housing 26. The direction of rotation of the impeller 14 is indicated by an arrow A.

Figure 2:
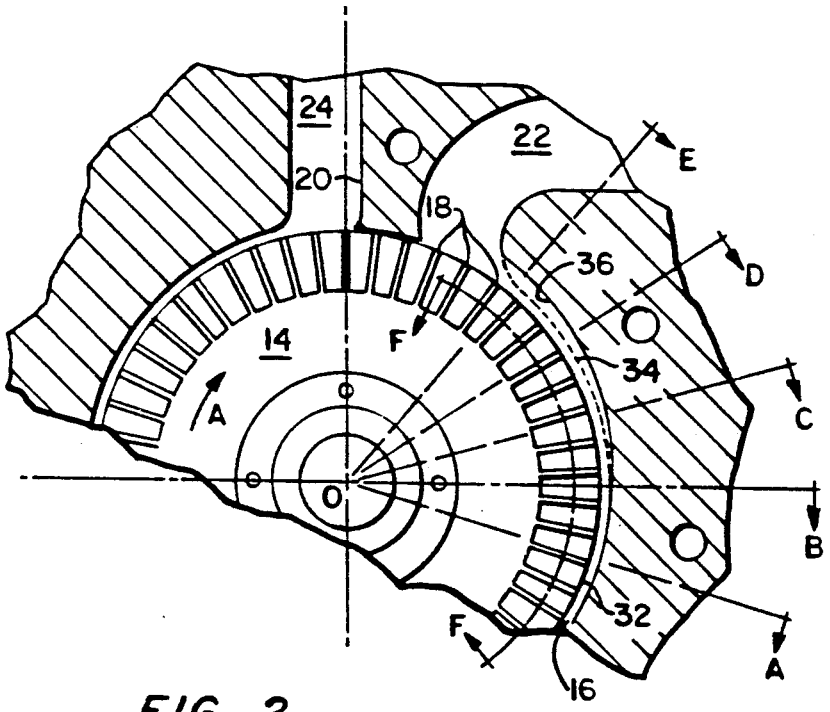
FIG. 2 is a fragmentary sectional view to a larger scale of a portion of the pump shown in FIG. 1.
Figure 3:
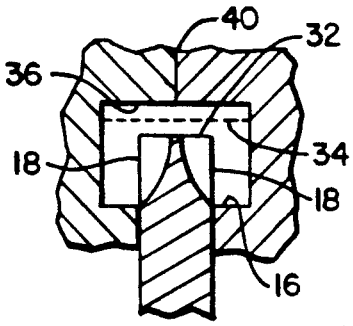
FIG. 3 is a sectional view taken along the line O-E of FIG. 2.
Figure 4:
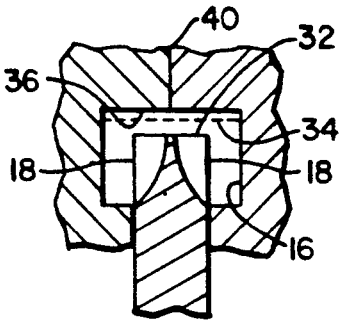
FIG. 4 is a sectional view taken along the line O-D of FIG. 2.
Figure 5:
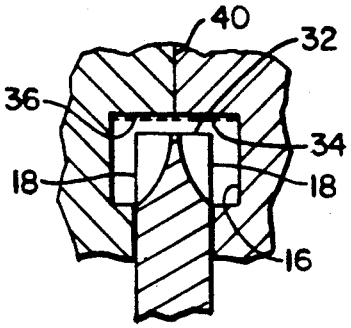
FIG. 5 is a sectional view taken along the line O-D of FIG. 2.

The inlet/outlet region of the pump 10 is shown in greater detail in FIG. 2 that more clearly shows the details of the invention. The impeller 14 is disposed in a channel or channel ring 16 which is a part of the housing 26.

Figure 8:
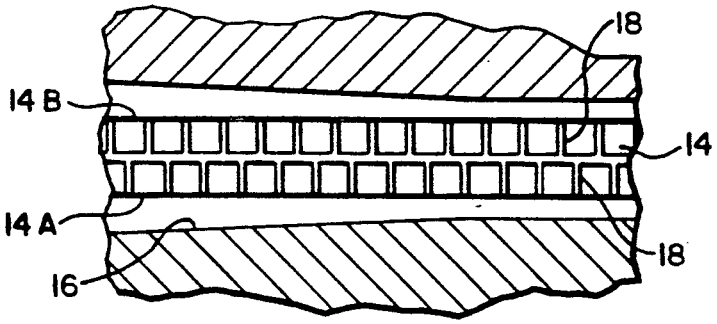
FIG. 8 is a sectional view taken along the arc F—F of FIG. 2.

The impeller 14 has parallel sides 14A, 14B and includes a plurality of vanes 18 that are disposed on both sides of the impeller 14 as best seen in FIGS. 3–8. The vanes 18 are offset from one axial side of the impeller 14 to the other as best seen in FIG. 8. The vanes are uniformly spaced within the channel ring 16. As best seen in FIGS. 3–7 the channel ring 16 is machined into the housing 26 which is cast as two axial sections. The parting line 40 indicates the plane in which the two axial portions of the housing join together. Those skilled in the art will recognize that the channel ring 16 is partly in one axial section of the housing 26 and partly in another axial section of the housing 26. The sides of the vanes 18 of the impeller 14 have increased side clearance with respect to the sides of the channel ring 16 in an arcuate portion near the inlet 22. This arcuate portion is approximately 45 degrees in extent as best seen in FIGS. 2 & 8. This axial clearance tapers from a maximum proximate to the inlet 22 to a uniform and smaller axial clearance at a location between section O-C and O-D shown in FIG. 2. The angular quadrant or arcuate portion of the channel ring 16 intermediate the section O-B and the outlet 24 has a uniform internal radius. Accordingly, the tips 32 of the vanes 18 in the angular sector between the section O-B and the outlet 24 have a uniform radial clearance.

In the single stage regenerative turbine pump in accordance with one form of the invention the fluid enters through the inlet 22 and passes into the channel 16 on both sides of the impeller 14 adjacent to a first circumferential part of the impeller 14. The vanes 18 carry the fluid within the channel 16 for almost a full revolution of the impeller 14. A blocker or splitter 20 directs the fluid through an outlet 24. Ordinarily the splitter 20 is disposed much closer to the impeller 14 than the channel ring 16. This is necessary to separate the inlet 22 fluid stream from the outlet 24 fluid stream.

The prior art channel ring 16 as best seen in FIGS. 2–5 has a wall defining the radial clearance between the channel ring 16 and the circumferential tips 32 of the vanes 18 indicated by the numeral 34. More specifically the line showing the prior art channel ring 16 contour is a dotted line. In this prior art construction the impeller 14 has vanes 18 that are disposed in a channel ring 16 that has a constant internal diameter (except at the location of the stripper 20 which must separate the high pressure region at the outlet 24 from the low pressure region 22 at the inlet).

Figure 6:
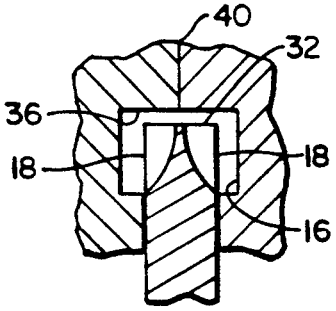
FIG. 6 is a sectional view taken along the line O-B of FIG. 2.
Figure 7:
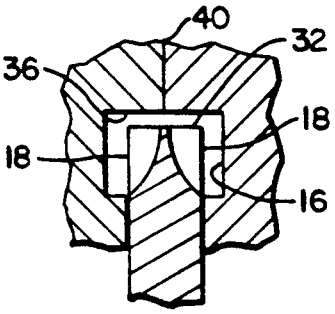
FIG. 7 is a sectional view taken along the line O-A of FIG. 2.

As best seen in FIGS. 2–6 the pump 10 in accordance with the invention provides an entrance region extending through an angular quadrant between the inlet 22 to the section O-B shown in FIG. 6. In the apparatus of the invention the channel ring 16 has a larger radial clearance between the tips 32 of the vanes 18 and the channel ring 16 in this angular quadrant.

The entrance region of the channel ring 16, in accordance with the invention, gradually decreases throughout an angular quadrant of the channel ring 16 as best seen in FIGS. 2–6. In a preferred form of the invention, the inside diameter of the channel ring 16 is uniform except at the splitter 20 and the angular extent of the entrance region. This angular extent may be up to 90 degrees.

The entrance region 36 is arcuate and has a radius that is somewhat larger than the existing channel internal surface radius and has a center that lies slightly above and to the left of the centerline O of the channel 16.

The invention has been described with reference to its illustrated preferred embodiment. Persons skilled in the art of such devices may upon exposure to the teachings herein, conceive other variations. Such variations are deemed to be encompassed by the disclosure, the invention being delimited only by the following claims.

Having thus described my invention I claim:

1. A regenerative turbine pump apparatus which comprises:

a housing having an inlet and an outlet;

an impeller mounted for rotation within said housing, said impeller having an outer diameter that is uniform throughout the angular extent thereof;

a channel ring disposed around said impeller, said channel ring having a first arcuate portion that has a first radius to provide a substantially uniform first clearance with respect to said outer diameter of said impeller, said first arcuate portion extending throughout a major part of said channel ring, said channel ring including a second arcuate portion proximate said inlet having a second clearance with respect to said outer diameter of said impeller that is greater than said first clearance, said second arcuate portion extending throughout 90 degrees.

2. The apparatus as described in claim 1 wherein:

said second clearance is greater nearer to said inlet than at parts thereof remote from said inlet.

3. The apparatus as described in claim 2 wherein:

said second clearance tapers from said first clearance to an increasingly greater clearance along the extent thereof.

4. The apparatus as described in claim 3 wherein: said second arcuate portion is arc shaped and has a radius greater than an arc defining said first arcuate portion.

5. The apparatus as described in claim 4 wherein: said second arcuate portion has a center of curvature that is different from a center of curvature of said first arcuate portion.

* * * * *